US012692039B1

(12) United States Patent
Greene

(10) Patent No.: US 12,692,039 B1
(45) Date of Patent: Jul. 28, 2026

(54) EASEL

(71) Applicant: Stanley Ewing Greene, Dallas, TX (US)

(72) Inventor: Stanley Ewing Greene, Dallas, TX (US)

( * ) Notice: Subject to any disclaimer, the term of this patent is extended or adjusted under 35 U.S.C. 154(b) by 0 days.

(21) Appl. No.: 18/779,829

(22) Filed: Jul. 22, 2024

Related U.S. Application Data

(60) Continuation-in-part of application No. 18/209,432, filed on Jun. 13, 2023, now Pat. No. 12,084,237, which is a continuation-in-part of application No. 17/392,044, filed on Aug. 2, 2021, now Pat. No. 11,702,240, which is a division of application No. 16/524,148, filed on Jul. 28, 2019, now Pat. No. 11,104,475, which is a continuation-in-part of application No. 16/386,220, filed on Apr. 16, 2019, now Pat. No. 11,076,665, which is a continuation-in-part of application No. 13/840,903, filed on Mar. 15, 2013, now Pat. No. 10,308,391.

(51) Int. Cl.
*B65D 5/42* (2006.01)
*A47B 97/04* (2006.01)

(52) U.S. Cl.
CPC ..... *B65D 5/42* (2013.01); *A47B 97/04* (2013.01)

(58) Field of Classification Search
CPC ..... A47B 97/04; B65D 5/42
See application file for complete search history.

(56) References Cited

U.S. PATENT DOCUMENTS 1,765,010 A * 6/1930 Gross ..... A47G 1/141 248/459
2,005,027 A * 6/1935 Ellsworth ..... B65D 5/26 229/149
2,159,887 A * 5/1939 Darragh ..... B65D 5/5206 206/45.25
2,542,180 A * 2/1951 Chemlinski ..... A24F 27/14 229/242
2,716,485 A * 8/1955 Hecker ..... B65D 5/52 206/45.25
3,130,510 A * 4/1964 Nichols ..... B42D 5/043 40/120
3,195,850 A * 7/1965 Steiner ..... A47B 23/043 248/459
4,149,630 A * 4/1979 Transport ..... B65D 5/5206 206/45.24
D260,491 S * 9/1981 Maclin ..... D9/433
4,291,798 A * 9/1981 Transport ..... A47G 1/141 206/45.24
4,479,318 A * 10/1984 Russell ..... A47G 1/0633 40/788
4,708,239 A * 11/1987 Bourbon ..... B65D 43/162 248/463
4,819,354 A * 4/1989 Papov ..... A47G 1/141 40/745
4,895,295 A * 1/1990 Montgomery ..... B65D 71/16 229/148
5,016,814 A * 5/1991 Fullerton ..... B65D 5/308 229/196
5,188,223 A * 2/1993 Brose ..... B65D 5/5206 206/45.24

(Continued)

*Primary Examiner* — Ernesto A Grano
(74) *Attorney, Agent, or Firm* — PAPALAS PLLC

(57) ABSTRACT

Embodiments describe an easel for holding and/or display one or more items. The easel are formed from a single piece of material.

8 Claims, 15 Drawing Sheets

(56) References Cited

U.S. PATENT DOCUMENTS 5,398,893 A * 3/1995 Barker ..... A63H 27/02 16/225
6,092,673 A * 7/2000 Woolnough ..... A47F 7/146 211/50
7,861,995 B2 * 1/2011 Liou ..... F16M 11/2021 248/459
D643,635 S * 8/2011 Harding ..... D6/310
8,136,678 B2 * 3/2012 Moss ..... A47F 5/112 211/73
8,235,208 B2 * 8/2012 Sirichai ..... A45F 5/02 206/45.24
D683,973 S * 6/2013 Pitts Brown ..... D6/310
D696,031 S * 12/2013 Pitts Brown ..... D6/310
9,010,758 B1 * 4/2015 Malmloff ..... A63F 1/10 273/148 A
D771,615 S * 11/2016 Pignotti ..... D6/310
9,901,174 B1 * 2/2018 Conrad ..... A47B 97/08
D811,753 S * 3/2018 Conrad ..... D6/310
10,010,204 B2 * 7/2018 Cronin ..... A47G 23/032
10,308,391 B1 * 6/2019 Greene ..... B65D 5/52
10,687,624 B2 * 6/2020 Conrad ..... A47F 5/112
11,076,665 B1 * 8/2021 Greene ..... B65D 5/52
D964,343 S * 9/2022 Nguyen ..... D14/447
11,998,113 B2 * 6/2024 Battilana ..... A47B 47/024
2007/0102384 A1 * 5/2007 Albenda ..... A47B 96/202 211/85.26
2010/0294683 A1 * 11/2010 Mish ..... A45C 11/00 206/320
2011/0247959 A1 * 10/2011 Nelson ..... A45F 5/00 206/525
2011/0315594 A1 * 12/2011 Sielski ..... B65D 5/003 206/557
2012/0043234 A1 * 2/2012 Westrup ..... A45C 13/02 206/320
2013/0048514 A1 * 2/2013 Corcoran ..... A45C 11/00 206/472
2014/0013637 A1 * 1/2014 Feagins ..... G09F 1/06 40/606.01
2018/0049549 A1 * 2/2018 Conrad ..... A47F 5/112
2019/0059576 A1 * 2/2019 Culver ..... A47B 23/044
2019/0091960 A1 * 3/2019 Woodman ..... B31D 5/04
2020/0121074 A1 * 4/2020 Orona ..... B42D 3/126
2020/0342794 A1 * 10/2020 Dalton ..... A47B 97/08

* cited by examiner

EASEL

RELATED APPLICATIONS

This application is a continuation-in-part of the U.S. patent application Ser. No. 18/209,432, filed on 13 Jun. 2023, entitled A BRACKET FOR SECURING A DEVICE TO A CONTAINER, the disclosure of which is hereby incorporated herein by reference in its entirety; which is a continuation-in-part of the U.S. patent application Ser. No. 17/392,044, filed on 2 Aug. 2021, entitled A POCKET HOLDER AND AN EASEL, the disclosure of which is hereby incorporated herein by reference in its entirety; which is a divisional application of U.S. patent application Ser. No. 16/524,148, filed on 28 Jul. 2019, entitled A POCKET HOLDER AND AN EASEL, the disclosure of which is hereby incorporated herein by reference in its entirety; which is a continuation-in-part application of U.S. patent application Ser. No. 16/386,220, filed on 16 Apr. 2019, entitled A CONTAINER AND STAND FOR A PORTABLE DEVICE, the disclosure of which is hereby incorporated herein by reference in its entirety; which is a continuation-in-part application of U.S. patent application Ser. No. 13/840,903, filed on 15 Mar. 2013, entitled A CONTAINER AND STAND FOR A PORTABLE DEVICE, the disclosure of which is hereby incorporated herein by reference in its entirety.

TECHNICAL FIELD

An easel for displaying articles or other items and their methods of making and methods of use are provided.

BACKGROUND

Recycling is a process using waste materials to form new products. Recycling prevents waste of new materials, and reduces the consumption of fresh raw materials, as recycling uses discarded or otherwise used materials to form the new products. Recycling may also reduce energy and water usage in the formation of materials from raw ingredients. Recycling also reduces pollution by preventing the disposal of the materials. For example, recycling reduces air pollution from incineration, and land and water pollution from land filling. Recycling is a key component of modern waste reduction and is the third component of the "Reduce, Reuse, Recycle" waste hierarchy.

SUMMARY

Embodiments of the invention are directed to an easel. One embodiment is an easel that holds an item, the easel comprises: a pocket that holds the item; and a support that is adjacent to and in contact with the pocket; wherein the pocket comprises: a plurality of surfaces that form a triangle; wherein the support comprises: another plurality of surfaces that form another triangle; wherein the pocket and the support are formed from a single piece of material.

BRIEF DESCRIPTION OF THE DRAWINGS

Figure 1:
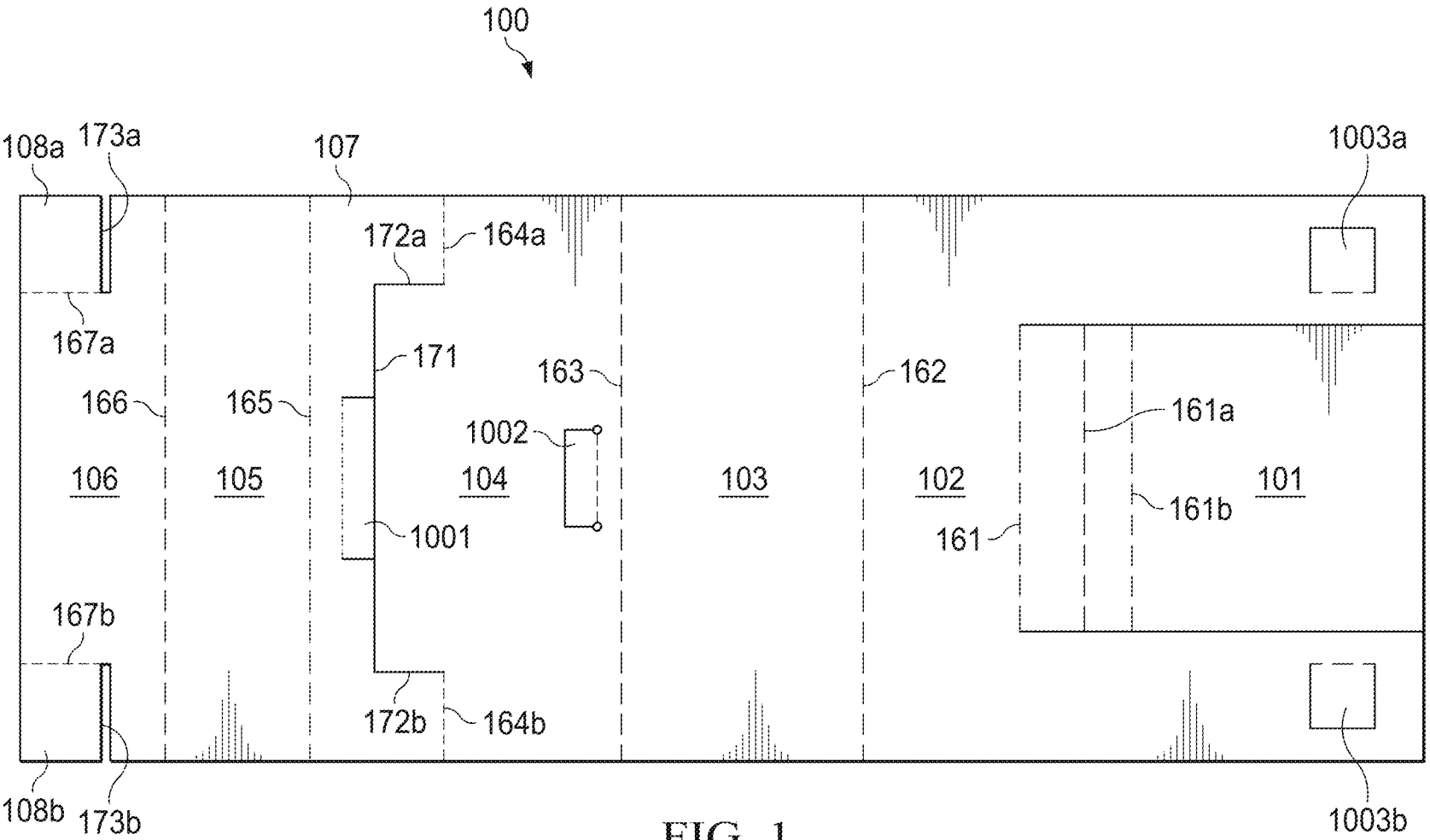
Figure 4:
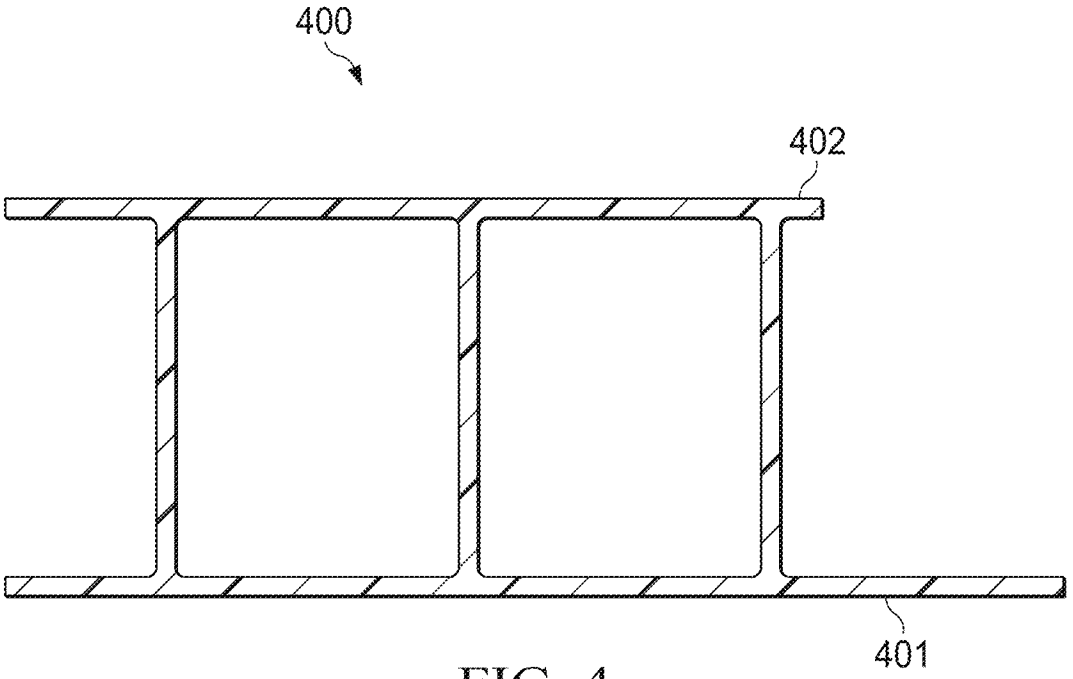

Having thus described the invention in general terms, reference will now be made to the accompanying drawings, which are not necessarily drawn to scale, and wherein:

FIG. 1 depicts an embodiment of an easel in an unfolded state;

FIGS. 2A-2G depict the easel of FIG. 1 being arranged to form the easel;

FIGS. 3A-3E depicts an alternative arrangement of the easel to form a bookend;

FIG. 4 depicts an unequal cut made into corrugated material; and

Figure 5:
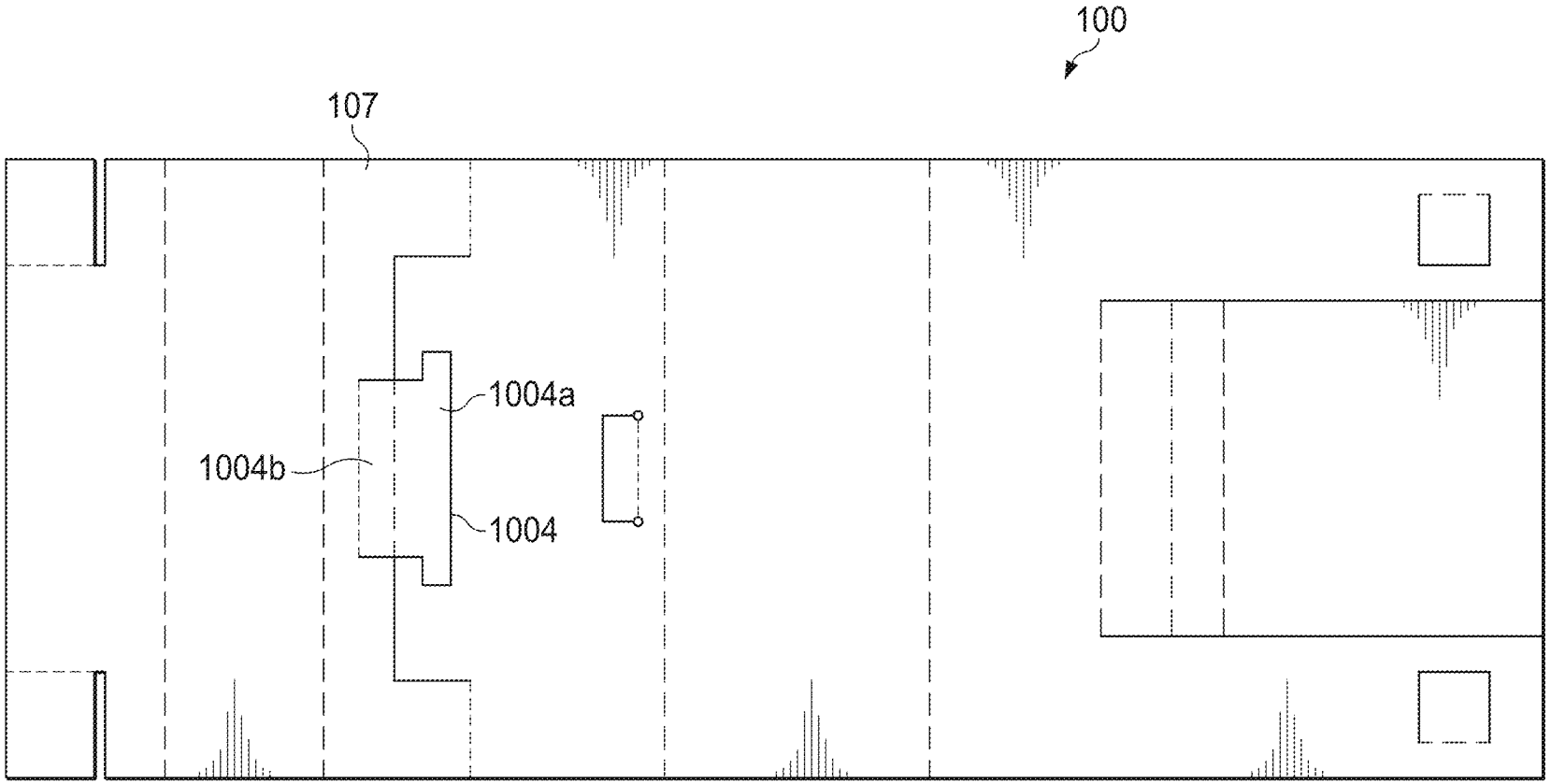

FIG. 5 depicts an alternative example of a notch.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

The easel described herein serves different functions expressed as modes. One mode of the easel is the display one or more items. As used herein display is defined as both a static display and a dynamic display. A static display is the display of an item that does not change, such as displaying a finished painting, a printed picture, or completed information such as a map. A dynamic display is the display of an item that changes with time. For example, a dynamic display is a painting that is being painted. A dynamic display may include an electronic device that can display a slide show of picture, a bulletin board that allows papers and other things to be mounted on the bulletin board. The item may be a marker board, a chalk board, or a paper tablet. The easel may be placed on a horizontal surface of a building such as floor or window sill. The easel may be placed on a piece of furniture such as a book case, desk, table, or appliance, such as a computer, a refrigerator, a washer, a dryer, etc. The easel may be placed on a horizontal surface a vehicle such as a dash board. The easel may be placed without being fixedly attached. Alternatively, the easel may be fixedly attached using one or more fasteners described above with respect to the pocket holder. Heavy or large items may unbalance the easel, and thus to prevent tipping over, a weight may be placed inside the support triangle 151 (FIG. 2G) to stabilize the easel. The easel described herein may be resized as needed to accommodate different sized items.

Another mode of the easel described herein serves as a book holder or a book end. The easel is arranged in a different manner to allow the easel to support books or other objects on a shelf or table, or other furniture item. The easel arranged as a book end would support one or more books or other objects in an upright manner and prevent the books or objects from falling over. The easel could be oriented to hold the books or objects upright by holding the books or objects against a wall, a piece of furniture, or other relatively stationary item. Two such easels could be arranged so that one or more books are supported between them.

As used herein, an electronic device may be a portable electronic device, a computer device, a display screen, an image projector, an IPAD, a notebook computer, an MP3 player, a personal data assistant, a cellular telephone, a camera, and a smart phone.

The easel described herein is preferably made from materials that have been used for other purposes. Thus, the easel described herein is preferably made from recycled materials.

One example of such a material is cardboard. The cardboard may be a portion of the packaging for the item(s) to be held or displayed. The cardboard may be packaging from other products, such as the cardboard backing from note pads. The cardboard should have sufficient strength to hold the item. The cardboard is preferably made of one piece that is sized to accommodate the item. The cardboard may be corrugated or non-corrugated. It is preferable that the cardboard be corrugated for the pocket holder or easel and be oriented such that the internal corrugation of the cardboard is perpendicular to the major structural folds, e.g. folds 161, 162, 163, 165 and 166. This is preferable to provide greater strength to surfaces 101, 102, 103, 104, 105 and 106. However, the corrugation may be oriented parallel to the major structural folds.

Note that the cardboard material may be coated with a water resistant material and/or reinforcing material, e.g. spray rubber or plastic coating, to provide some weather protection for the device and/or improve the durability of the container. The cardboard should be thin cardboard, as thick cardboard would be more difficult to work with.

Another example of such a material is corrugated plastic. One example of corrugated plastic is polypropylene plastic or PP plastic and is typically marked with the recycling number 5. Polypropylene is desirable because the plastic is resistant to fatigue, and thus can be bent or folded multiple times without breaking. Note that other plastics may be used. The corrugated plastic may be a portion of the packaging for the item(s) to be held or displayed. The corrugated plastic may be packaging from other products, or from other sources such as a yard sign, e.g. political signs, real estate signs. The corrugated plastic should have sufficient strength to support the item. Corrugated plastic has two common thickness sizes, 2 and 4 millimeters. The 2 millimeter thick plastic has corrugation cell chambers that are 2 millimeters thick and about 3 millimeters in length. The 4 millimeter thick plastic has corrugation chambers that are 4 millimeters thick and about 5.5 millimeters in length. The corrugation cell typically has a mostly square cross-section. The corrugated plastic is preferably made of one piece that is sized to accommodate the device. The plastic may be a portion of the packaging for the item(s) to be held or displayed.

It is preferable that the plastic be corrugated for the pocket holder and/or easel and be oriented such that the internal corrugation of the plastic is perpendicular to the major structural folds, e.g. folds 161, 162, 163, 165 and 166. This is preferable to provide greater strength to surfaces 101, 102, 103, 104, 105 and 106. This is also preferable for simplicity. To form a fold that is parallel, the plastic strip between two cells may need to be removed, meaning two cuts to form one fold. However, the corrugation may be oriented parallel to the major structural folds. Note that if corrugated plastic is used, then to make the various cuts for the container may require additional material to be removed to form cavities instead of only cutting plastic. For example, the strip of plastic between the cell walls of the corrugation may be removed in its entirety rather than make one cut in the cell. This will better allow the folding to occur.

As used herein, a peak fold is a fold that forms an inverted letter V, with the peak facing upward with respect to the view or out of the page with respect to the view. A valley fold is a fold that forms a letter V, with the peak facing downward with respect to the view or into the page with respect to the view.

FIG. 1 depicts an embodiment of the easel 100. FIG. 1 depicts a top view of the pocket holder 100 in an unfolded state. The easel 100 in this embodiment maybe made from thin cardboard or plastic as discussed above. Note that a bottom view would be the same as the top view, except for the direction of the peak and valley folds. The easel may be formed by using a one or more die(s) in a press to cut the pattern. The various peak and valley folds may also be formed by one or more die(s) in a press. Alternatively, a pattern for the pocket holder may be traced or printed onto a piece of material, and the various cuts and folds may be made by hand.

In FIG. 1, the easel 100 comprises a plurality of surfaces. The easel 100 comprises the Flap Surface 101, the Base Surface 102, the Back Surface 103, the Front Top Surface 104, the Front Pocket Surface 105, the Lower Inside Surface 106, the Support Surface 107, the Pocket Latch Tabs 108*a,b*.

Figure 2A:
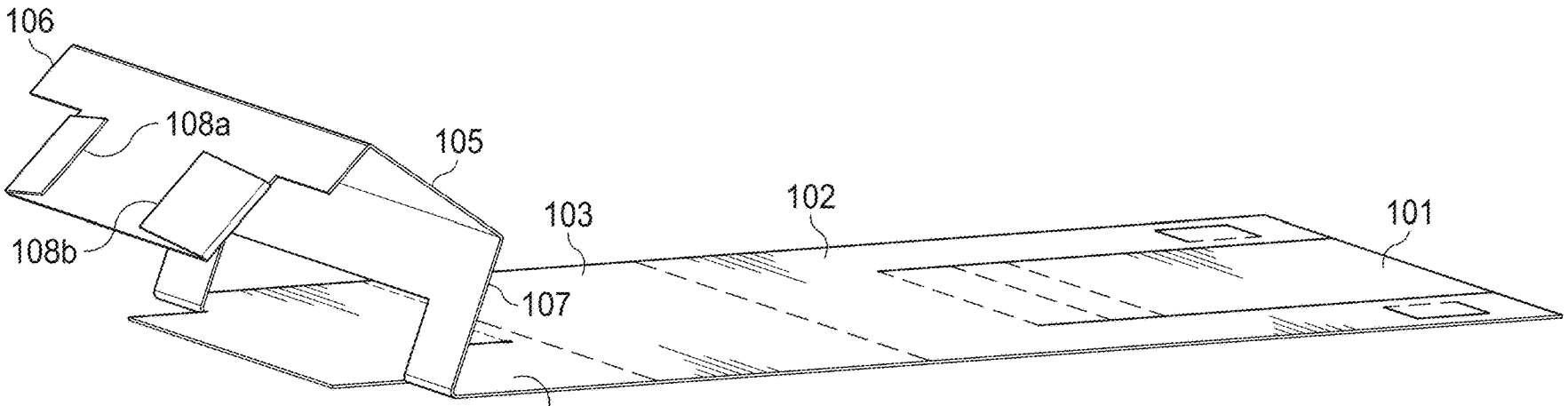
Figure 2B:
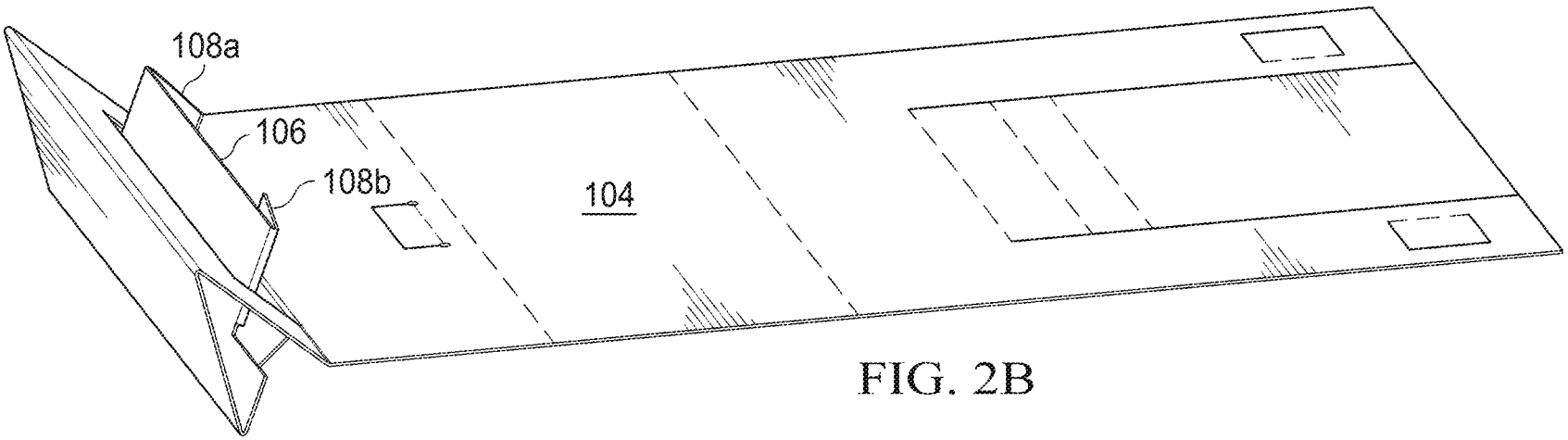
Figure 2C:
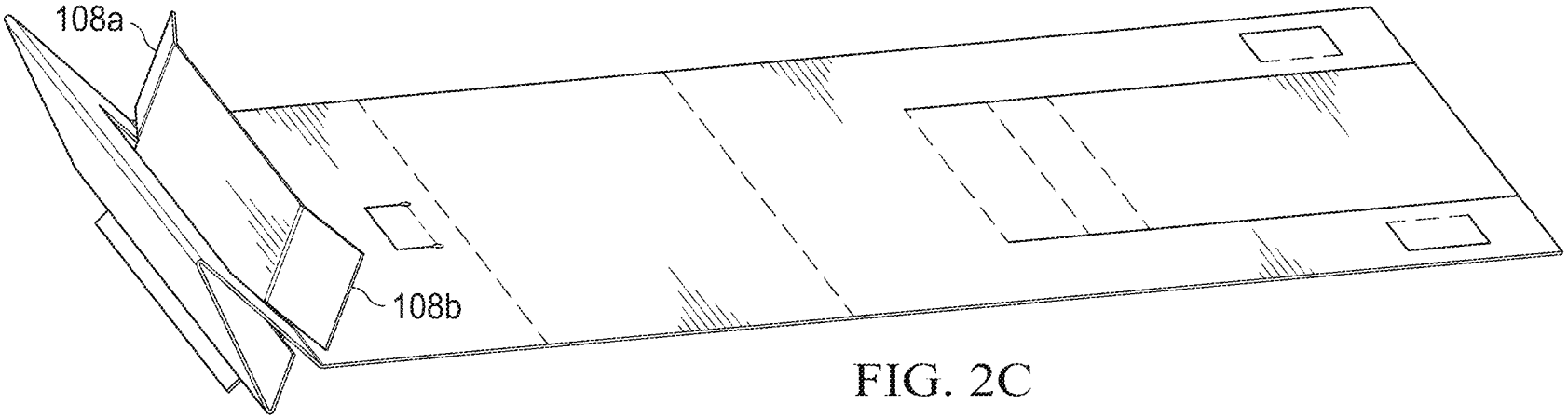
Figure 2D:
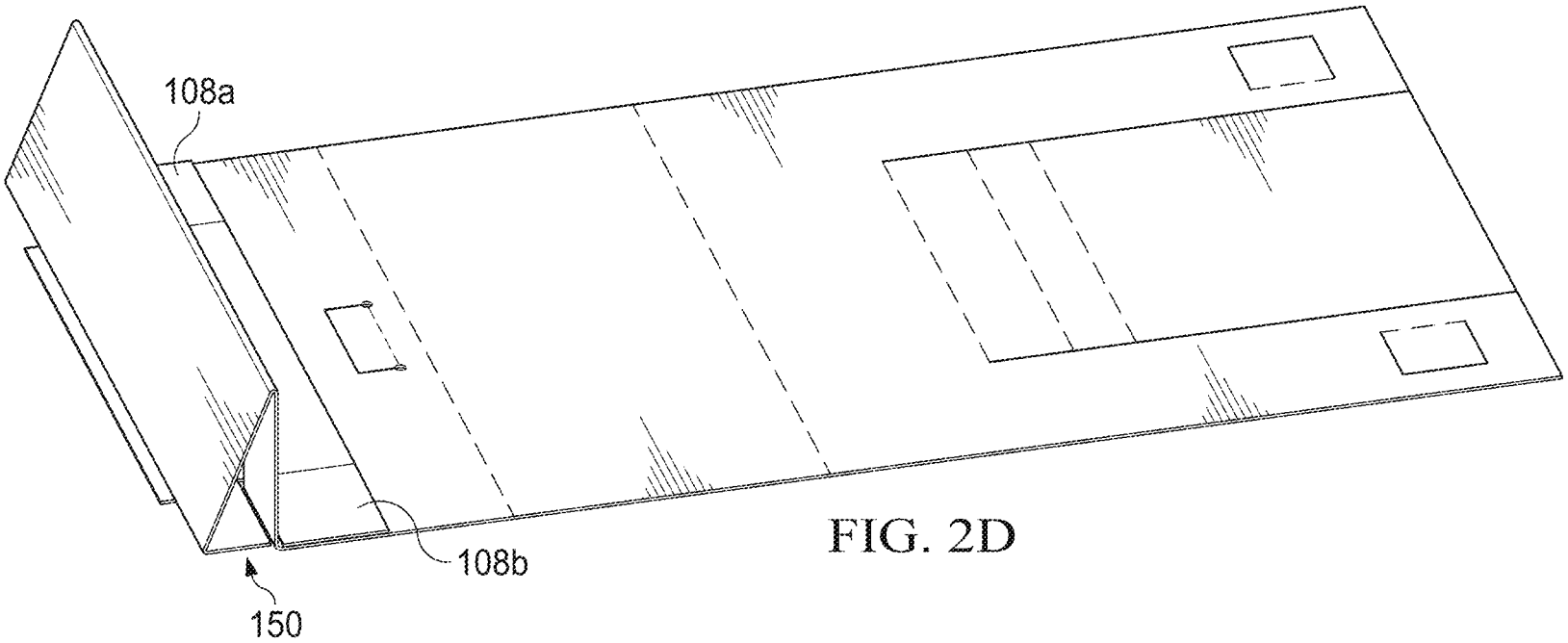
Figure 2E:
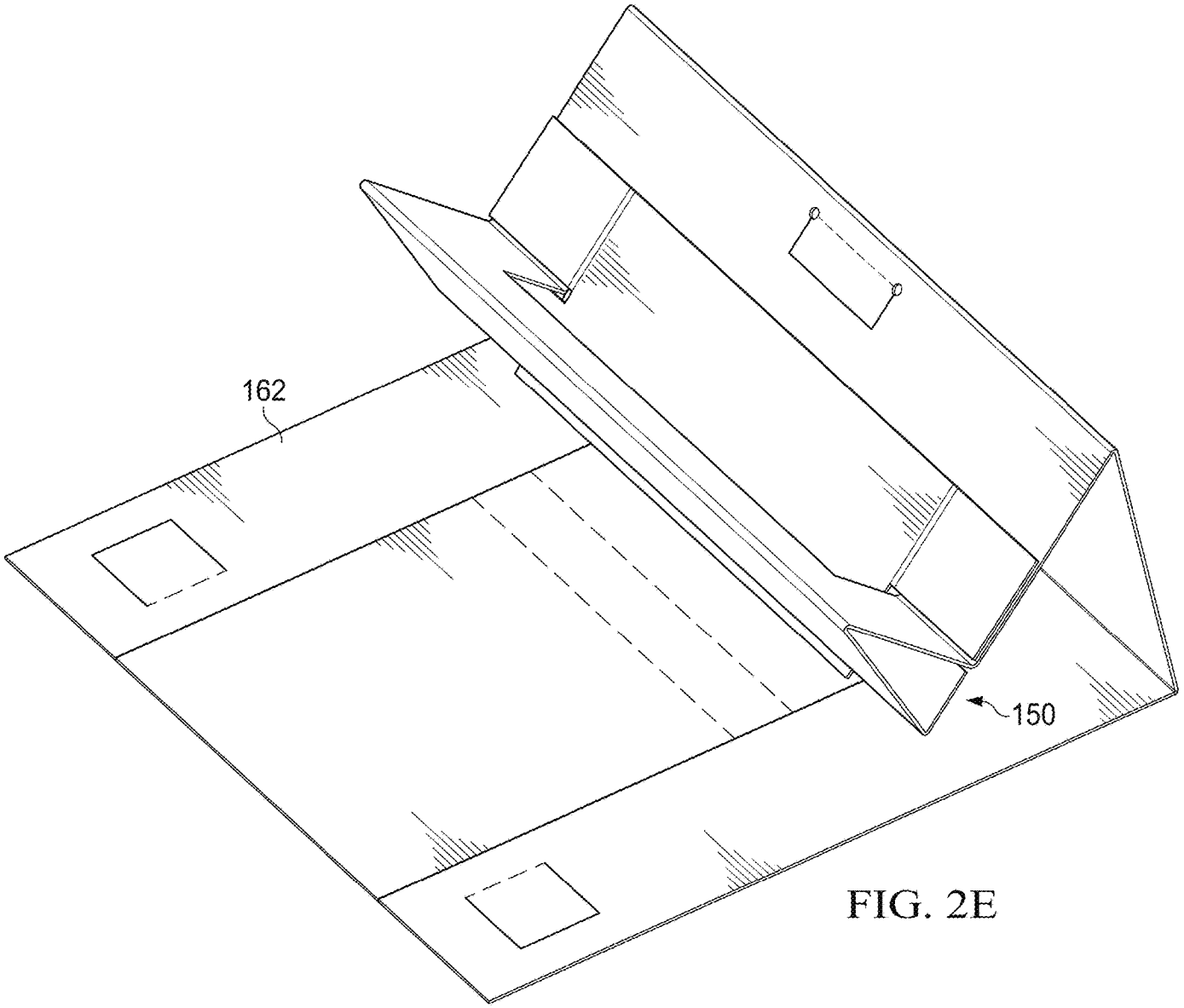
Figure 2F:
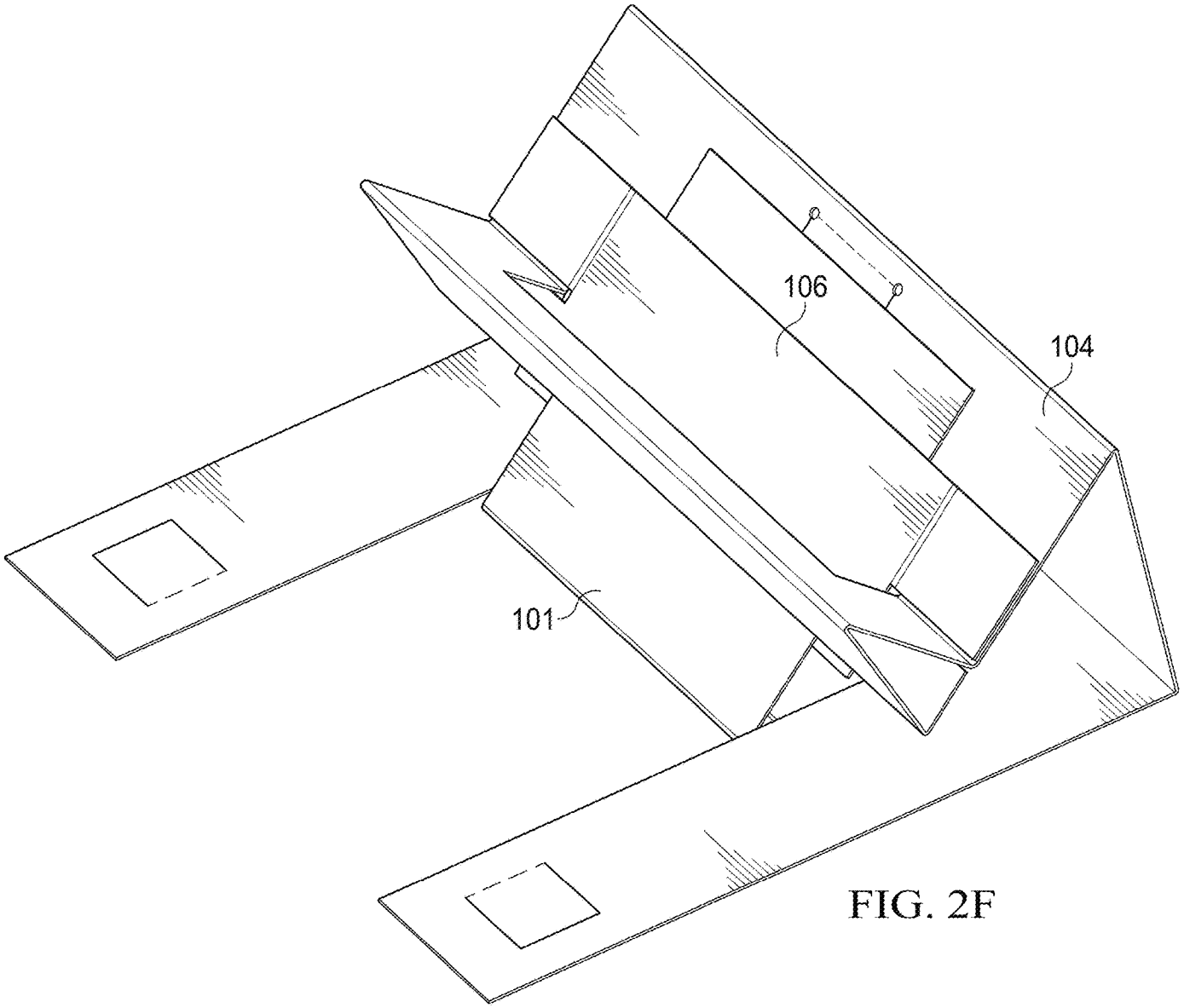
Figure 2G:
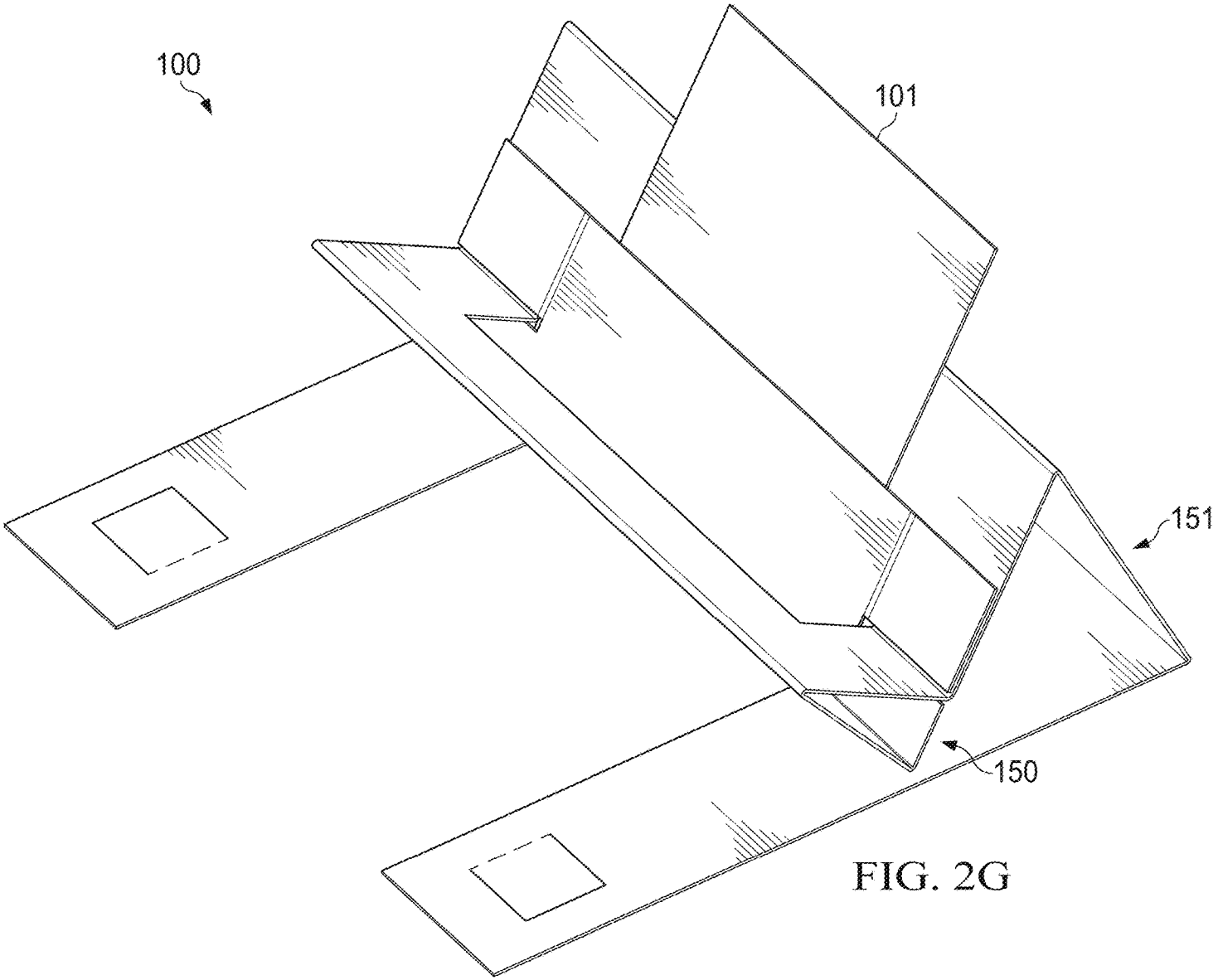

The flap surface 101, the base surface 102, the back surface 103, and the front top surface 104 form the support triangle 151 (FIG. 2G). The flap surface 101 and the front top surface 104 form one side of the support triangle 151. The back surface 103 forms another side of the support triangle 151. The base surface 102 forms another side of the support triangle 151.

The base surface 102 would be placed upon an external surface or object upon which the easel rests during use. The external surface may be a portion of a piece of furniture, e.g. a table, or other object, e.g. the user's lap, torso, chest, abdomen, or hand, upon which the user(s) is going to view or use the item on the easel. The base surface 102 may merely rest upon the surface or may be fixedly attached to the object surface using one or more fasteners described above.

The easel 100 also includes the pocket triangle 150 (FIG. 2G), which is formed from the Front Pocket Surface 105, the Lower Inside Surface 106, and the Support Surface 107. The front pocket surface 105 forms the front of the pocket triangle 150 and one side of the triangle. The lower inside surface 106 forms the rear of the pocket triangle 150, and another side of the triangle. The support surface 107 form the upper sides of the pocket triangle 150, and another side of the triangle. The pocket latch tabs 108*a,b* lock the pocket triangle 150 against the flap surface 101 and the front top surface 104.

In FIG. 1 the easel 100 has a plurality of folds. The Front Bottom Fold 161 is the fold between the flap surface 101 and the base surface 102. The Back Bottom Fold 162 is the fold between the base surface 102 and the back surface 103. The Top Fold 163 is the fold between the back surface 103 and the front top surface 104. The Rear Side Folds 164*a,b* are the folds between the front top surface 104 and the support surface 107. The Front Side Fold 165 is the fold between the support surface 107 and the front pocket surface 105. The Pocket Bottom Fold 166 is the fold between the front pocket surface 105 and the lower inside surface 106. The Tab Folds 167*a,b* are the folds between the lower inside surface 106 and the pocket latch tabs 108*a,b*.

Folds 161, 162, 163, 165, and 166 are peak folds with respect to FIG. 1. Folds 164*a,b* and 167*a,b* are valley folds with respect to FIG. 1. For a bottom view (not shown), the peak and valley folds would be reversed.

Optionally, the flap surface may comprise additional folds 161*a,b*. This would allow that different lengths of the flap surface to be inserted into the easel, thereby changing the angle that easel forms between the front top surface 104 and the base surface 102. Using fold 161 would also allow for the maximum length of flap surface 101 to be inserted into the easel to protrude above the support triangle 151 and provide additional support for a tall object to the placed into the easel. Note that an additional flat stiff object may be inserted into the easel adjacent to the flap strap 101 to allow the easel to hold tall objects.

In FIG. 1 the easel 100 has a plurality of cuts. The Front Pocket Cut 171 is the cut between the front top surface 104 and the support surface 107. The Side Pocket Cuts 172*a,b* are the cuts between the front top surface 104 and the support surface 107 and the front pocket surface 105. When the device is folded into the easel, the cuts 171 and 172*a,b* form a cavity into the triangle pocket 150. The Tab Cuts 173*a,b* are the cuts between the lower inside surface 106 and the pocket latch tabs 108*a,b* and form the Pocket Latch Tabs 108*a,b*.

As compared to the easel of the U.S. patent application Ser. No. 16/524,148, filed on 28 Jul. 2019, entitled A POCKET HOLDER AND AN EASEL, the ease 100 has a smaller cavity formed in the pocket triangle 151 than that of the ease of U.S. patent application Ser. No. 16/524,148, filed on 28 Jul. 2019, entitled A POCKET HOLDER AND AN EASEL. However, this allows for the support surface 107 to extend from one side of the easel to the other, rather than being two smaller side surfaces 207a,b as shown in U.S. patent application Ser. No. 16/524,148, filed on 28 Jul. 2019, entitled A POCKET HOLDER AND AN EASEL. This would allow for heavier items to be displayed in the easel 100. Smaller items can still be placed in the cavity of pocket triangle 151. Larger objects would rest upon support surface 107.

The easel may include Notch 1001, which is an optional feature that allows for oversized objects to be placed on the easel 100. In this case, an oversized object would not rest in the pocket triangle 150, but rather would rest on top on support surface 107. The notch 1001 would prevent the object from slipping off the easel 100. The notch 1001 is formed by making two additional cuts and one more valley fold 1001*a* as shown in FIG. 1. Note that additional valley and peak fold may be placed in the notch that are parallel to fold 1001*a*. This allows the notch to be more flexibly positioned to secure an object in the easel 100. Also note that the object may be placed behind that flap surface 101 and in front of the front top surface 104.

The easel 100 may include strap flap 1002, which is an optional feature that allows for a strap to be attached to the easel 100 to more securely hold objects to the easel 100. The strap flap 1002 is formed by making three additional cuts and an additional valley fold as shown in the FIG. 1. The strap flap includes two holes that are sized in accordance with the diameter of the strap that is to be placed through the strap flap 1002. The strap flap 1002 is used by opening the flap and inserted the strap into the flap, the strap is then moved into the holes and the flap is closed. The strap flap 1002 can be closed over the strap before the strap is moved into the holes.

Note that there may be a plurality of strap flaps on the easel 100 so that multiple straps can be used to secure one or more objects to the easel. There may be a plurality of straps for one strap flap 1002. Note that the strap may be a rubber band or other elastic material. Alternatively, the strap may be cordage, e.g. paracord, that is tied to the object. Alternatively, the strap may have a bracket that fits around the object, such as the bracket of U.S. patent application Ser. No. 18/209,432, filed on 13 Jun. 2023, entitled A BRACKET FOR SECURING A DEVICE TO A CONTAINER.

The easel may include book flaps 1003*a,b*, which are optional features would be used when the easel is formed into a bookend holder. Each book flap 1003*a,b* is formed by making three additional cuts and an additional peak fold as shown in the FIG. 1. See the discussion of FIGS. 3A-3E.

The object may also be glued or taped to the easel.

The easel 100 may also be folded into a storage state. In this arrangement the unfolded easel of FIG. 1 is flipped over, so that the bottom side is face up. The flap surface 101 and base surface 102 are folded along back bottom fold 162, so that surfaces 101 and 102 contact back surface 103 and front top surface 104. The lower inside surface 106 is folded along pocket bottom fold 166, so that surface 106, along with latch tabs 108*a,b*, contact front pocket surface 105. When the easel is folded in this manner, the easel is formed into a rectangular shape with a low form factor. This a plurality of easel can readily be stored in a container.

FIGS. 2A-2G depict the easel 100 being assembled from the unfolded state of FIG. 1.

FIG. 2A depicts surfaces 105, 106, and 107 being raised above surfaces 101, 102, 103, and 104. Tabs 108*a* and 108*b* are folded over surface 106.

FIG. 2B depicts the latch tabs 108*a,b*, along with the lower inside surface 106 being pushed up into a hole formed by cuts 171 and 172*a,b*.

FIG. 2C depicts the latch tabs 108*a*, 108*b* being opened back up.

FIG. 2D depicts the latch tabs pushed flat against surface front top surface 104. This forms that pocket triangle 150.

FIG. 2E depicts the assembled pocket triangle 150 is moved to be located above base surface 102.

FIG. 2F depicts that flap surface 101 being inserted between front top surface 104 and the lower inside surface 106 from the bottom of the pocket triangle 151. One way to insert the flap surface 101 is to pinch the pocket triangle 150, this causes the surface 104 and 106 to open thereby allowing an easier insertion of the flap surface 101, rather than prying surfaces 104 and 106 apart. This forms the support triangle 151.

FIG. 2G depicts assembled easel 100. Note that the pocket formed inside the pocket triangle has an angle such that when a plurality of similar objects placed into the pocket, e.g. brochures, the front most object will be higher than the next object. This allows for objects to be more easily removed from the easel.

FIGS. 3A-3E depicts an alternative assembly of the easel 100 into a bookend 200. The process shown in FIGS. 2A-2E would be followed to result in the easel 100 as shown in FIG. 2E.

Figure 3A:
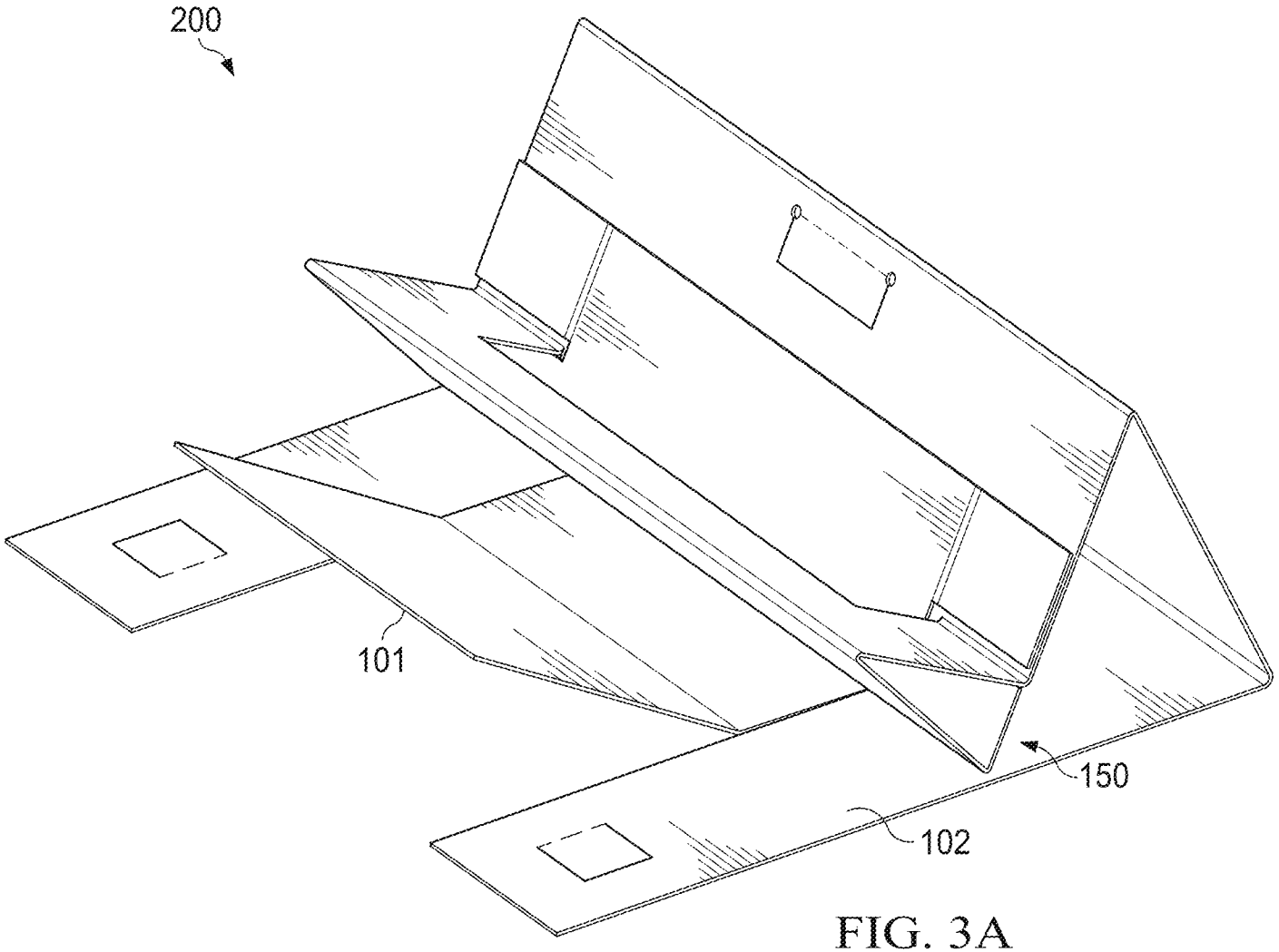

FIG. 3A depicts the easel 200 of FIG. 2E where the assembled pocket triangle 150 is moved to be located above base surface 102. The flap surface 101 is moved in front of the pocket triangle.

Figure 3B:
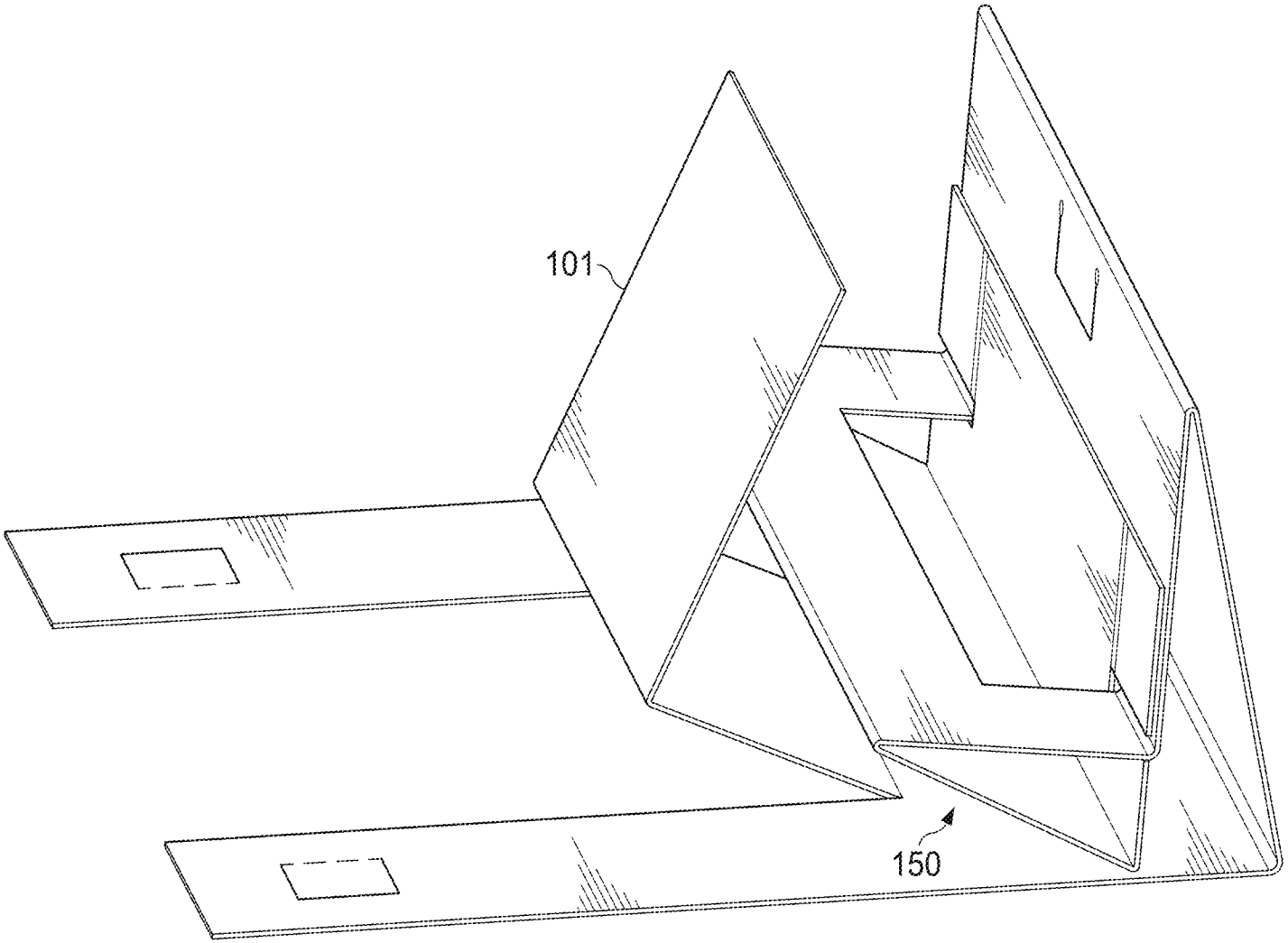

FIG. 3B depicts the easel 200 where the flap surface 101 is moved in front of and over the pocket triangle 150.

Figure 3C:
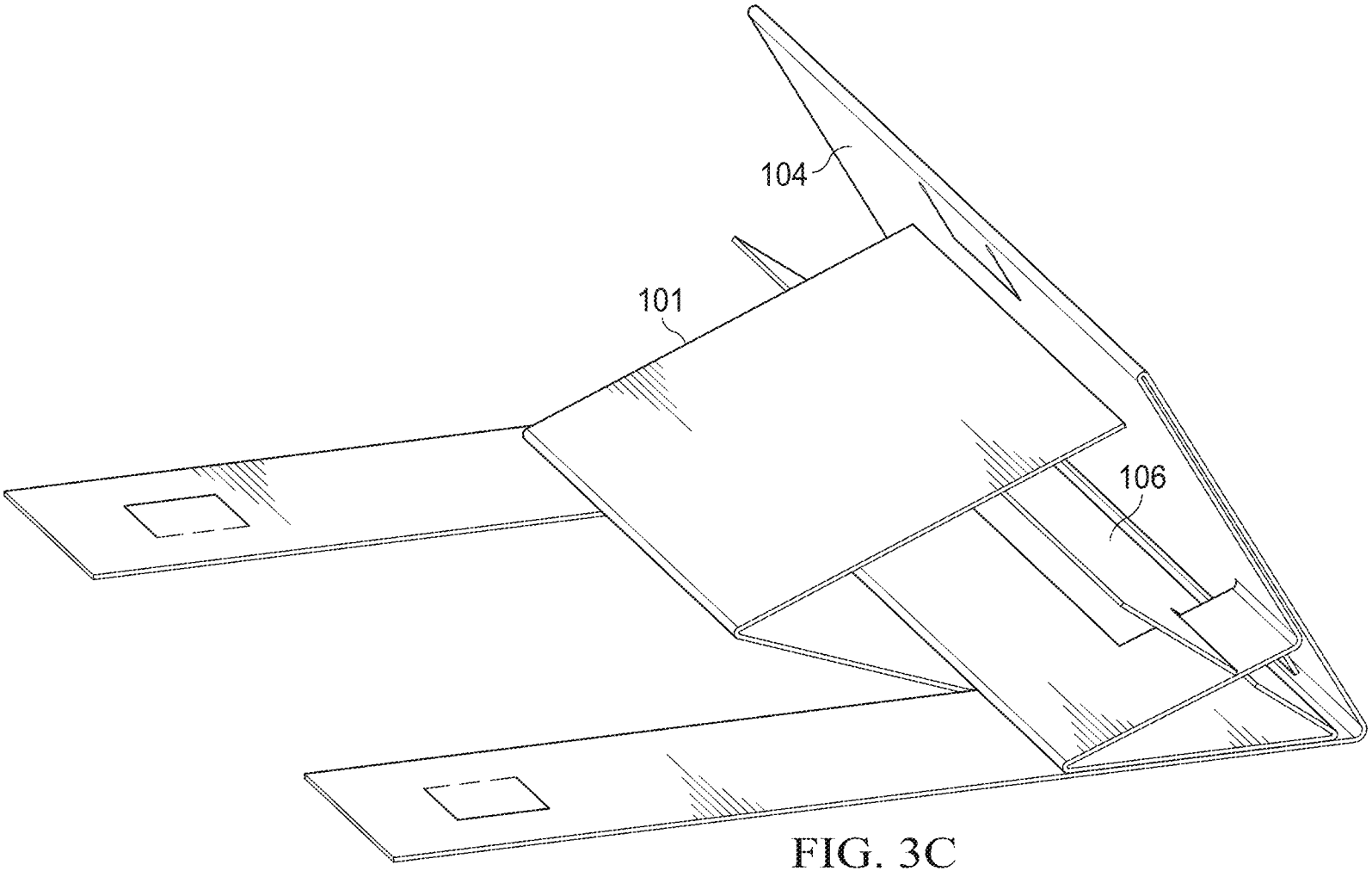

FIG. 3C depicts the easel 200 where the flap surface 101 is moved down the front top surface 104 towards the pocket triangle 150. The flap surface 101 is then inserted between the front top surface 104 and the lower inside surface 106.

Figure 3D:
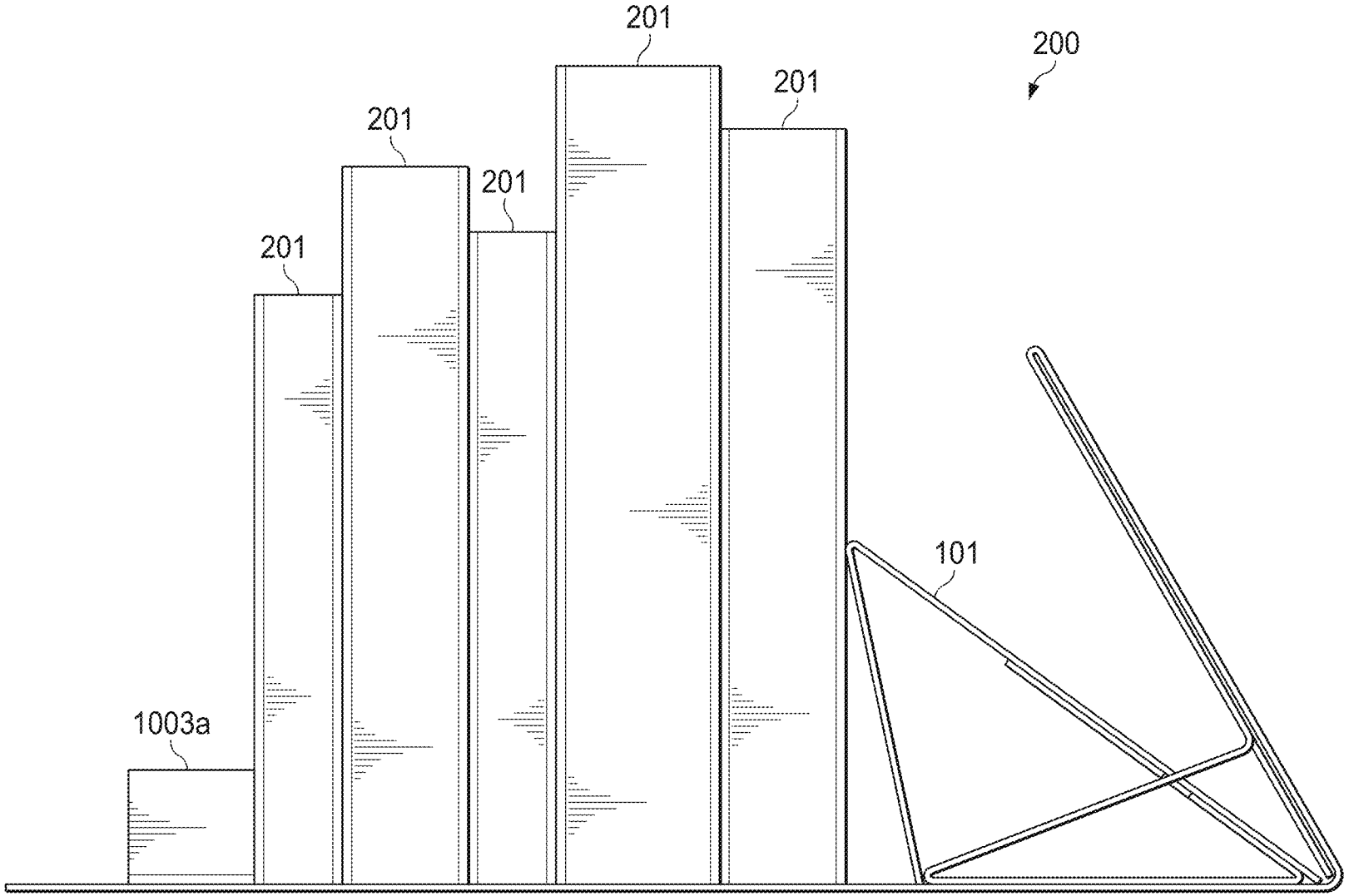

FIG. 3D depicts the bookend easel 200 configured as a book end whereby flap surface 101 serves the book 201 support on one side and the bookend flaps 1003*a,b* serves the book support on the other side. Note that the bookend easel 200 can be used to hold objects or items other than books.

Figure 3E:
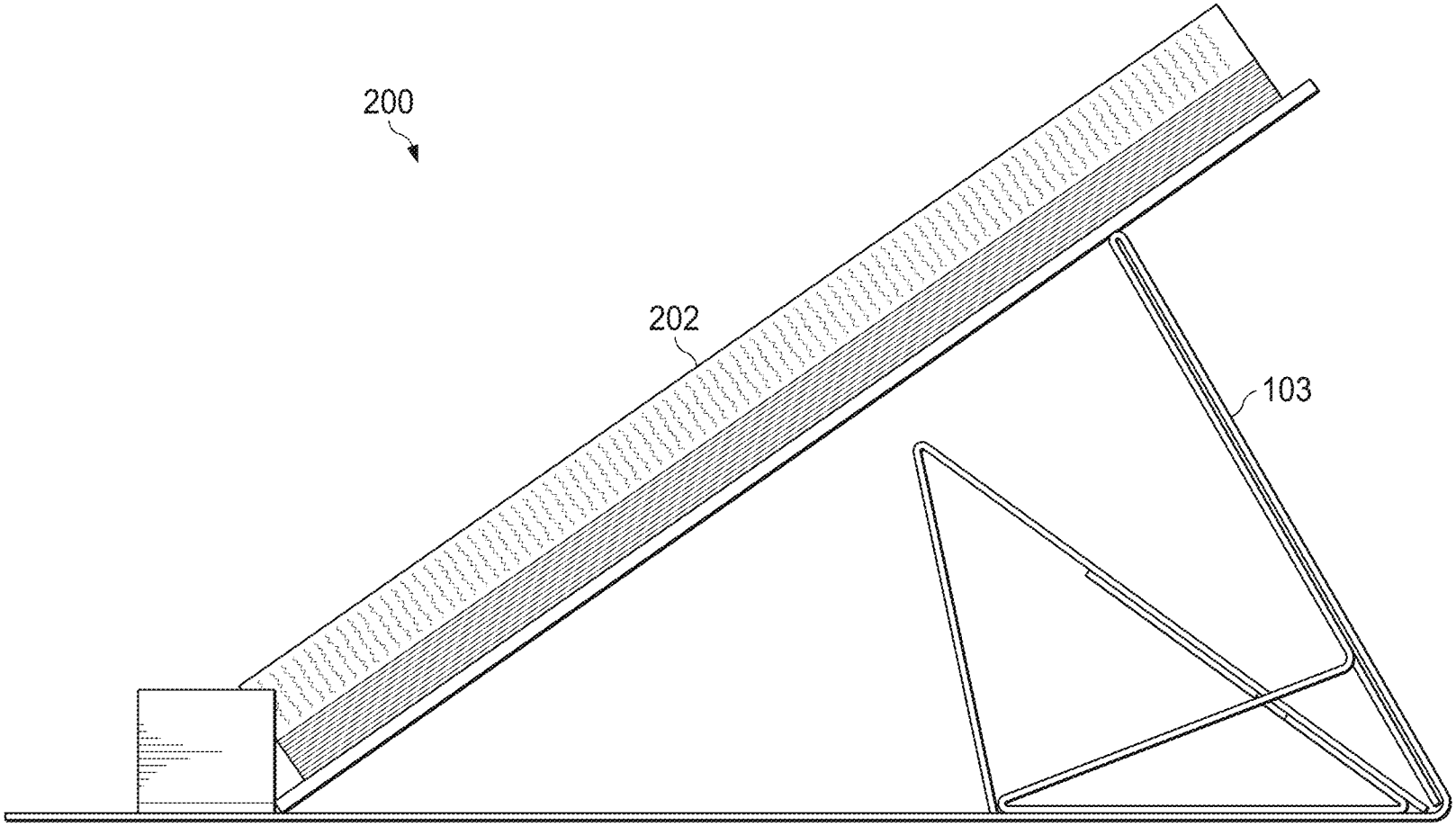

FIG. 3E depicts the bookend easel being used to support a book 202 in an open position. The back surface 103 supports the book. One example book is a cookbook.

FIG. 4 depicts a unequal cut 400 of a corrugated material. The cut 400 results in one side 401 being longer than the other side 402. This cut 400 is useful for the flap strap 101, the strap flap 1002 and the bookend flaps 1003*a,b*. This cut 400 makes it harder to move the flap from the flat position to an open position and vice versa. It is preferred that the backside of the flap have the longer cut 401. If the easel 100 is using either fold 161*a* or 161*b* rather than 161, the easel can flex if the remaining portion of the flap surface is not locked into the base surface 102. The unequal cut 401 would provide such a lock. This is useful if the object placed into the easel 101 is relatively light. In other words, the unequal cut 401 maintains the flap surface 101 and the base surface 102 in the desired position.

FIG. 5 depicts an alternative example of a notch 1004. The T-shaped notch 1004 locks that notch 1004 securely to support surface 107. The notch 1004 is formed by making four additional cuts, one additional peak fold, and one additional valley fold as shown. Raised portion 1004*b* folds up from support surface 107. Lock portion 104*a* folds down, with the T-shape moving under the support surface 107. This locks the notch 1004 in place, and prevents a heavy object from moving the notch 1004.

Note that the cross-section of the pocket triangle 150 and the support triangle 151 are triangles. The sizes of the different surfaces of the pocket triangle 150 and the support triangle 151 may be varied to yield other triangle shapes. Other surfaces may be added or removed to form other cross-sections such as a square, rectangle, parallelogram, a pentagon, or other polygon shapes. Note that the number and dimensions of the surfaces may be modified, and the dimensions and locations of the folds and cuts may be modified to allow for different sized items to be placed in the easel.

Note that the cross-sectional shapes described herein may not be exact. Differences in the various dimensions of the cuts, folds, and surfaces may cause the cross-section of the pocket triangle 150, and the support triangle 151 to be more polygon-shaped. Additionally, heavy or light items may also cause distortions in the cross-sections of the pocket triangle 150, and the support triangle 151 to make the cross-sections more polygon-shaped. Thus, as used herein terms such as triangle, square, rectangle, parallelogram, etc. used to describe a shape, should be understood to mean substantially triangle, substantially square, substantially rectangle, substantially parallelogram, etc.

As used herein, the words "comprise," "have," "include," and all grammatical variations thereof are each intended to have an open, non-limiting meaning that does not exclude additional elements or steps.

The easel may undergo additional processing to smooth the edges and cuts, such as heating or sanding to remove sharp edges.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An easel that holds an item for display, the easel comprises:

a support surface that includes a cavity, wherein one of the support surface and the cavity holds the item for display;

a pocket triangle that includes the support surface and the cavity; and a support triangle that is adjacent to and in contact with the pocket triangle;

wherein the pocket triangle comprises a plurality of surfaces that form the pocket triangle;

wherein the support triangle comprises another plurality of surfaces that form the support triangle;

wherein the pocket triangle and the support triangle are formed from a single piece of material.

2. The easel of claim 1, wherein at least one item is placed on the support surface of the holder.

3. The easel of claim 1, wherein at least one item is placed into the cavity of the holder.

4. The easel of claim 1, wherein the material is at least one of a biodegradable material, a recycled material, a cardboard material, a polypropylene plastic, or a corrugated material.

5. The easel of claim 4, wherein the material is a polypropylene plastic that has corrugations, wherein the easel comprises:

a plurality of folds;

wherein a majority of the plurality of folds is perpendicular to a direction of the corrugations.

6. The easel of claim 1, wherein the pocket triangle comprises:

a front pocket surface that includes a notch;

a first side support surface located on one side of the cavity; and a second side support surface located on an opposite side of the cavity from the first side support surface;

wherein a large item that has a dimension that is larger than a dimension of the cavity of the pocket triangle is placed onto the easel and is supported by the first and second side support surfaces and the notch.

7. The easel of claim 6, wherein the notch has a T-shape.

8. The easel of claim 1, further comprising:

a strap for holding the item to the easel; and a strap flap for attaching the strap to the easel.

* * * * *